United States Patent [19]

Le Tixerant

[11] Patent Number: 4,459,795

[45] Date of Patent: Jul. 17, 1984

[54] BITLESS HARNESSING SYSTEM

[76] Inventor: Eric Le Tixerant, 8, Rue Erlanger, 75008 Paris, France

[21] Appl. No.: 463,114

[22] Filed: Feb. 2, 1983

[30] Foreign Application Priority Data

Feb. 2, 1982 [FR] France ..... 82 01626
Jan. 25, 1983 [FR] France ..... 83 01075

[51] Int. Cl.[3] ..... B68B 1/02; B68B 1/04
[52] U.S. Cl. ..... 54/6 A; 54/24
[58] Field of Search ..... 54/6 A, 14, 15, 16, 54/24, 35

[56] References Cited

U.S. PATENT DOCUMENTS 1,333,474 3/1920 De France ..... 54/15
2,347,752 5/1944 Schmelz ..... 54/15 X
2,572,517 10/1951 Ratliff ..... 54/15 X
3,312,039 4/1967 Reed ..... 54/24
4,337,610 7/1982 Taylor ..... 54/15 X
4,343,136 8/1982 Le Tixerant et al. ..... 54/16 X

*Primary Examiner*—Robert P. Swiatek
*Attorney, Agent, or Firm*—Watson, Cole, Grindle & Watson

[57] ABSTRACT

Bitless harnessing system which permits driving a horse by gripping its nose, including a tie resting on the nape of its neck. The ends of the tie carry rings which are connected together by a noseband. Stop blocks are provided in advance of the rings and limit the travel of pulleys to which snap-hooks are fixed. The snap-hooks are linked up by an underjaw. Ties connect the snap-hooks with the rings. The reins are attached to the snap-hooks. The harness may be provided with a frontal and a throat-lash.

9 Claims, 4 Drawing Figures

BITLESS HARNESSING SYSTEM

This invention is related to a harnessing system which does not include a bit and comprises a head peice resting on the nape of a horse's neck, a nose-band and an under-jaw or a curb chain, the nose-band and the under-jaw cooperating for exerting a pressure on the horse's nose.

Some bitless harnessing systems are already known for holding, fatiguing or riding a horse.

But either those known systems do not control the horse enough or they are too coercive.

Then, among the first systems there are the halter and the cavesson to be mentioned.

A halter is a flexible harness within which a horse's head may be freely engaged; it permits of holding the horse on condition of it being of a quiet disposition. If not, only the muscular strength of the ostler will prevent the horse of breaking loose.

A cavesson comprises a rigid nose band tightly belted on the horse's nose. It is used for lunging with a right hand lead or with a left hand lead as well. The steadiness of the cavesson, adjusted with difficulty, is poor for a horse raising its head. Frequently this device does not work well with difficult horses or works too hard with delicate horses.

The "Akamor", like the cavesson, includes a rigid nose band having at its end the rotating spindle of a cranked lever and the shorter arm of this lever supports the curb chain. The reins hang on the longer arms at their ends. Pulling the reins reduces the wedging strain on the horse's nose between nose-band and curb chain. This is a very hard coercive means, which requires much experience on the part from the horseman and is seldom used.

The two latter harnessing devices are expensive and relatively heavy.

The object of the invention is to provide a harness deprived of a bit, which is simple and easily adjusted and works equally well with difficult and delicate horses. Moreover it may be used as a halter while admitting a perfect control of the horse.

The harnessing system in accordance with the invention is a remarkable one because the head peice includes a tie whose ends carry rings which run in the groove of a pulley and stop blocks which limit the displacement of the pulleys towards the rings and towards the head, a flexible nose-band for connecting the rings together, and an under-jaw hooked up to snap-hooks fixed to the pulleys.

The following description, together with the drawings, given as examples only, will make apparent the manner in which the invention my be carried into practice.

Figure 1:
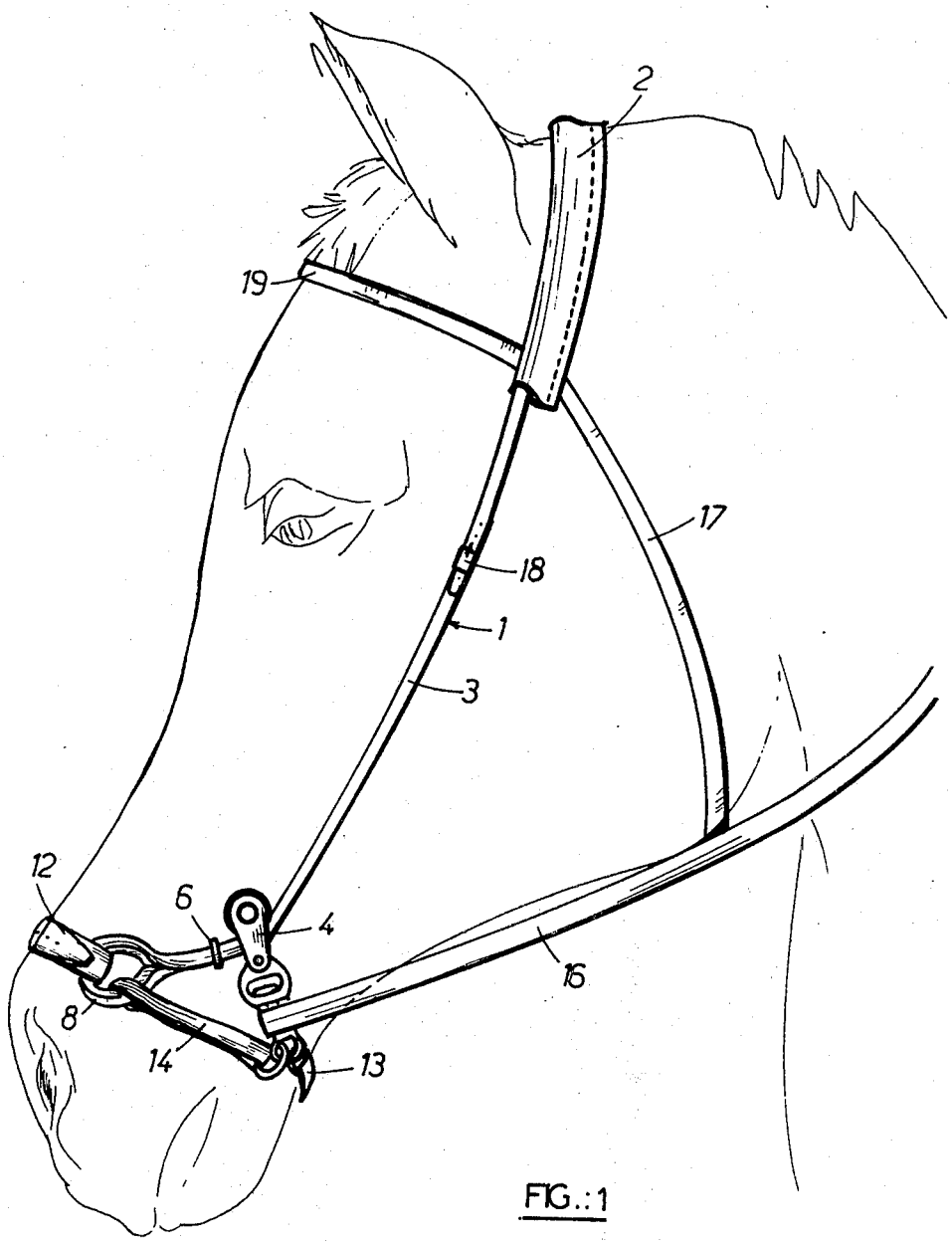
FIG. 1 shows an embodiment of the harnessing system fitted to a horse.
Figure 2:
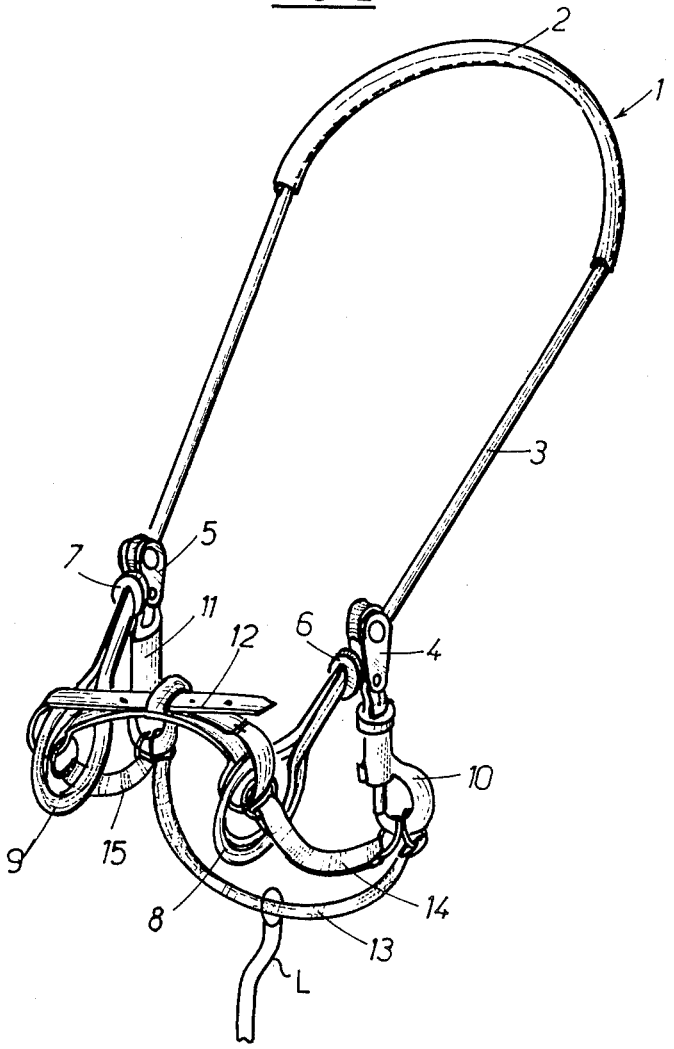
FIG. 2 is a perspective view of the harnessing system of FIG. 1.

The system shown in FIGS. 1 and 2 comprises at least one head piece 1 including a sheath 2 resting on the nape of the horse's neck and through which a tie element 3 extends. A pair of connecting elements each include a fastener 10, 11 at one end and a pulley 4, 5 at the outer end spaced from the fastener. Each end of the tie element 3, extending through the spacings between the groove of pulley 4, 5 and 10, 11, carries several stop blocks 6, 7 for limiting the travel of the pulleys toward the ends that carry the rings 8, 9.

The fasteners comprise swivelling catch-hooks 10, 11.

The rings 8, 9 are linked up by a flexible part 12 (nose-band) which extends over the horse's nose, and hooks 10, 11 are linked up by a flexible part 13 (under-jaw or curb chain) which is provided so as to be located under the horse's mouth. The lengths of the nose-band and the under-jaw are adjustable so as to match the conformation of the harnessed horse.

The above-enumerated elements make up a harness of the halter type. The lunge L is hooked up to the mid-point of the under-jaw. In a situation where one pulls the lunge, the tie 3 is subjected through the intermediary of the pulleys 4 and 5 to a tensile force which is transmitted to the nose-band 12 and the sheath 2. Thus the head is maintained between the sheath, acting as a head stall, and the flexible ring formed by the nose-band and the under-jaw.

The above-described halter may be transformed into a bitless harness by adjoining two ties 14, 15 between the corresponding snap-hooks 10, 11, and the rings 8, 9 that carry the nose-band. The reins 16 extend from the bodies of the snap-hooks through the intermediary of rings.

In a situation where the horseman exerts no action on the reins, the pulleys abut against the stop blocks 6, 7 and the slightly tensioned tie 3. Supposing than that the reins will be pulled, the pulleys 4, 5 cease to bear against the stop blocks and move towards the head, pulling the tie parts situated on either side of the head, whereby the shape of an obtuse angle is obtained. The distance between the sheath 2 placed on the nape and the ring formed by the nose-band 12, under-jaw 13 and ties 14, 15 assembly, is lessened and has for its effect to drive the horse's nose into the ring and consequently to increase the gripping pressure.

The above-described bitless harnessing system may eventually be completed by a frontal or head-band 19, which is fixed to the sheath 2 of the head piece, and a throat-lash 17 also fixed to the sheath 2.

In order to accomodate possibly different morphologies of horses, means are provided for adjusting the length of tie 3, for instance with the assistance of such a length adjusting device as a buckle 18 arranged on a portion of tie 3.

The sheath of the head piece 1 placed on the nape of the horse's neck has for its function to protect the skin against application of and rubbing due to the tie. This sheath should be sufficiently wide to avoid galling. It may consist, as known per se, of a piece of soft material such as a sheep skin, or the tie may have a sufficiently wide and tender surface. A tie having such characteristics may be obtained by using a lapped rope or a tubular cord.

Figure 3:
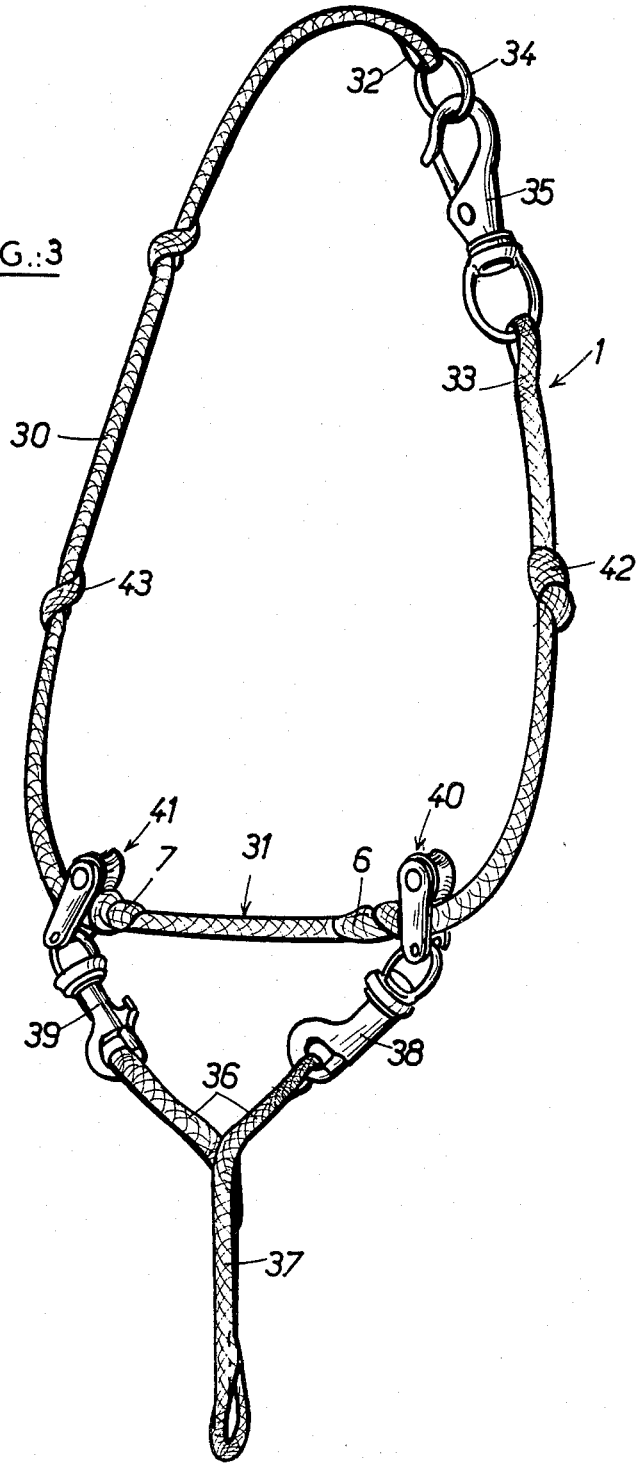
FIG. 3 is an example of a halter.
Figure 4:
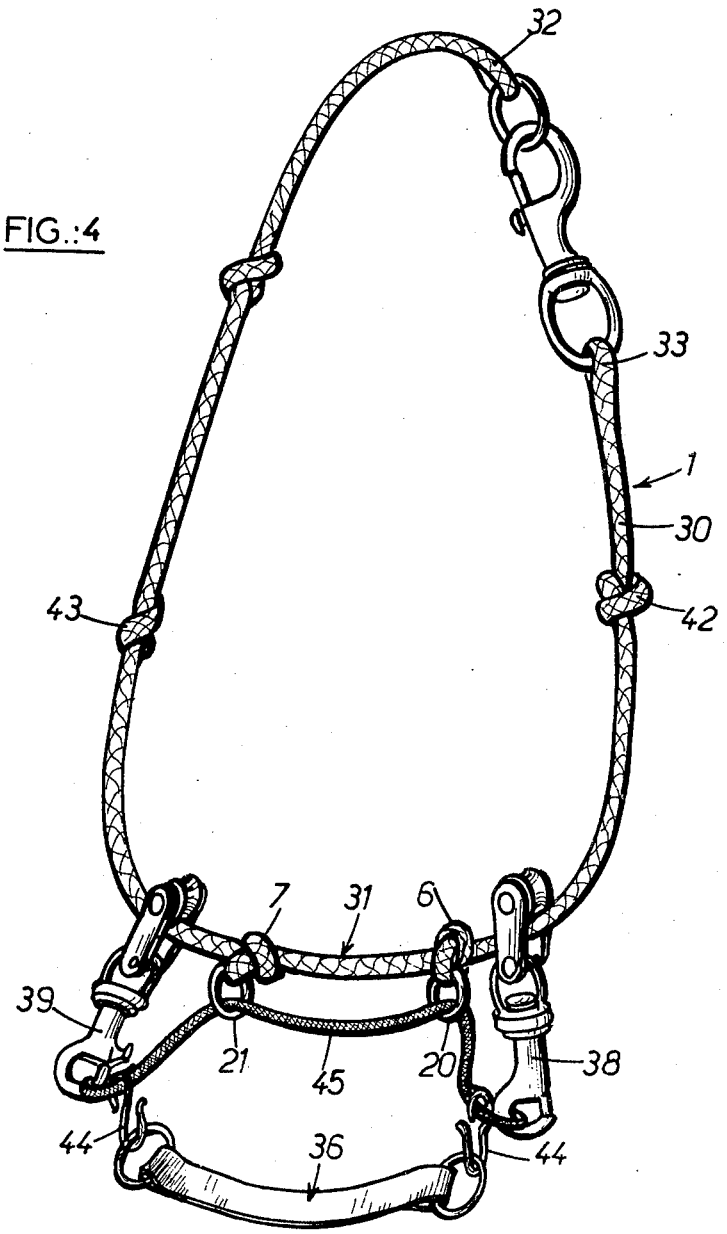
FIG. 4 shows an embodiment of a bitless harness according to the invention.

The embodiments shown in FIGS. 3 and 4 are manufactured with the use of such materials.

In order to simplify manufacturing, tie 30 and nose-band 31 are made of a single piece. The ends 32 or 33 of the tie have means for hooking up and possibly for adjusting the length, i.e. for instance a ring 34 and a hook 35, so as to effect the adjustment of the head piece.

Adjustment of length may be provided by making one or several knots in a part of the tie near the hooking up means as shown in FIGS. 3–4.

In manufacturing the halter according to FIG. 3, the under-jaw 36 and the bridle 37 are formed of a single piece. The ends of the part forming the under-jaw carry buckles which cooperate with the snap-hooks 38, 39 that are fixed to the shells of pulleys 40, 41.

When the halter is in use and the horse is being pulled, the pulleys will move so far that they abut against the stop blocks or knots 6 and 7 and apply a pressure, through the intermediary of the nose band 31, on the horse's nose. On the other hand, when the horse overtakes, the pulleys glide towards the ends 32 and 33 of the tie and the under-jaw rises towards the horse's throat. With a view to maintain a smooth control, two additional stop blocks 42, 43 are provided and located at a certain distance from the first stop blocks 6 and 7, towards the nape of the horse's neck. The pulleys 40, 41 will come onto the former stop blocks and stop there in case of overtaking by the horse. The stop blocks could be made by several blocks formed in the tie or by several elements inserted and fixed to the corresponding tie parts.

In FIG. 4 there is shown a bitless harnessing system in which the elements of the halter are still to be found, at least partly. In this embodiment the under-jaw 36 is a part deprived of a bridle. The under-jaw is hooked up in a known manner to the hooks of the snap-hooks 38 and 39 either directly by its end rings or with the intermediary of the hooks 44. The connection of the snap-hooks with the rings 20 and 21 is formed by one single tie piece 45 running through both rings and having its ends fixed to the snap-hooks.

With a view to simplifying the above-described systems the pulley-snatch hook combinations may be replaced by snatch-hooks. Every snatch-hook swivels directly on a ring of a type similar to the one referenced by 35 in FIG. 3, this ring being able to glide along the tie between the abutments 6 and 42 as well as 7 and 43.

I claim:

1. A bitless horse harnessing system, comprising a head piece having a portion adapted to rest against the nape of a horse's neck, said head piece comprising a tie element having opposite ends; a flexible nose band interconnecting said ends and being adapted to extend over the horse's nose; a pair of connecting elements, each including a fastener at one end and a pulley at the other end, which is spaced from said fastener, said tie element ends extending partially about said pulleys such that said connecting elements are respectively movably connected along said tie element near its opposite ends; first stop blocks located on said tie element between the respective ends thereof and the respective pulleys of said connecting elements for limiting the displacement of the connecting elements toward said nose band; a flexible under-jaw element interconnecting the fasteners of said connecting elements and adapted to extend under the horse's mouth; said nose band and said under-jaw element comprising a flexible ring; and a lunge element connected to said under-jaw element, whereby a pull on said lunge element effects a tensioning of said tie element via the pulleys of said connecting elements, said tensioning being transmitted to said nose band and to said head piece portion for maintaining the horse's head between said head piece portion and said flexible ring.

2. The system according to claim 1, further comprising ties interconnecting said ends to said fasteners.

3. The system according to claim 1, wherein said tie element and said nose band are comprised of a single piece of material.

4. The system according to claim 1, wherein connecting rings are attached at said ends of said tie element.

5. The system according to claim 4, further comprising ties interconnecting said ends to said fasteners, said ties being formed of a single tie piece extending through said rings.

6. A bitless horse harnessing system, comprising a head piece having a portion adapted to rest against the nape of a horse's neck, said head piece comprising a tie element having opposite ends; a flexible nose band interconnecting said ends and being adapted to extend over the horse's nose; a pair of connecting elements, each including a fastener at one end and a pulley at the other end, which is spaced from said fastener, said tie element ends extending partially about said pulleys such that said connecting elements are respectively movably connected along said tie element near its opposite ends; first stop blocks located on said tie element between the respective ends thereof and the respective pulleys of said connecting elements for limiting the displacement of said connecting elements toward said nose band; a flexible under-jaw element interconnecting the fasteners of said connecting elements and adapted to extend under the horse's mouth; a pair of ties interconnecting said tie element ends to said fasteners; the nose band, the under-jaw element and said pair of ties forming a flexible and inextensible ring; and reins attached between the pulleys and the fasteners of said connecting elements, whereby a pull on said reins results in a movement of the horse's nose into said flexible and inextensible ring.

7. The system according to claim 6, wherein said tie element has second stop blocks thereon located between said pulleys and said head piece portion for limiting the displacement of said pulleys toward said head piece portion at the nape of the horse's neck.

8. The system according to claim 4, wherein said connecting rings are attached to said first stop blocks.

9. The system according to claim 6, wherein said tie element and said nose band are comprised of a single piece of material.

* * * * *